US008378778B2

(12) United States Patent
Duval et al.

(10) Patent No.: US 8,378,778 B2
(45) Date of Patent: Feb. 19, 2013

(54) VARISTOR COMPRISING AN ELECTRODE HAVING A PROTRUDING PORTION FORMING A POLE AND PROTECTION DEVICE COMPRISING SUCH A VARISTOR

(75) Inventors: Michael Duval, Bagnères-de-Bigorre (FR); Alain Lagnoux, Rabastens-de-Bigorre (FR)

(73) Assignee: ABB France, Rueil-Malmaison Cedex (FR)

( * ) Notice: Subject to any disclaimer, the term of this patent is extended or adjusted under 35 U.S.C. 154(b) by 138 days.

(21) Appl. No.: 13/083,041

(22) Filed: Apr. 8, 2011

(65) Prior Publication Data

US 2011/0248816 A1 Oct. 13, 2011

(30) Foreign Application Priority Data

Apr. 9, 2010 (FR) ..... 10 52735

(51) Int. Cl.
*H01C 7/10* (2006.01)

(52) U.S. Cl. ..... 338/20; 338/13; 361/127

(58) Field of Classification Search ..... 338/20
See application file for complete search history.

(56) References Cited

U.S. PATENT DOCUMENTS

| | | | | |
|---|---|---|---|---|
| 5,148,345 | A * | 9/1992 | Allina | 361/104 |
| 5,760,336 | A * | 6/1998 | Wang | 174/535 |
| 5,781,394 | A | 7/1998 | Lorenz et al. | |
| 6,188,307 | B1 * | 2/2001 | Katsuki et al. | 338/22 R |
| 6,252,488 | B1 | 6/2001 | Ziegler et al. | |
| 6,307,462 | B2 * | 10/2001 | McLoughlin | 338/21 |
| 6,323,750 | B1 * | 11/2001 | Lampl et al. | 338/21 |
| 6,430,019 | B1 * | 8/2002 | Martenson et al. | 361/124 |
| 7,483,252 | B2 * | 1/2009 | de Palma et al. | 361/127 |
| 2006/0245125 | A1 | 11/2006 | Aszmus | |

FOREIGN PATENT DOCUMENTS

| | | |
|---|---|---|
| DE | 10 2007 042 991 | 12/2008 |
| DE | 10 2008 048 644 A1 | 2/2010 |
| DE | 20 2009 013 505 | 4/2010 |
| EP | 0 716 493 A1 | 6/1996 |
| EP | 0 867 896 | 9/1998 |
| EP | 0 905 839 A1 | 3/1999 |
| EP | 0 987 803 A1 | 3/2000 |
| EP | 2 278 605 | 1/2011 |
| FR | 2 877 156 | 4/2006 |
| WO | WO 2007/017736 | 2/2007 |

OTHER PUBLICATIONS

French Search Report dated Nov. 19, 2010 (with English language translation of category of cited documents).
Written Opinion.

(Continued)

*Primary Examiner* — Kyung Lee
(74) *Attorney, Agent, or Firm* — Buchanan Ingersoll & Rooney PC

(57) ABSTRACT

An exemplary varistor is disclosed which includes at least two poles; a non-linear block; a conductive plate arranged on a main face of the block and having a protruding portion forming one of the poles; and an electrically insulating coating applied to the main face of the block. The part forming the connection pole emerges from the electrically insulating coating and has a braze surface extending above the electrically insulating coating; and the protruding part forming the connection pole is connected to the rest of the plate over at least half of the perimeter thereof.

20 Claims, 7 Drawing Sheets

OTHER PUBLICATIONS

Search Report dated Jun. 12, 2011, issued in the corresponding European Patent Application No. 11 16 1708.
Search Report dated Jun. 14, 2011, issued in the European Patent Application No. 11 16 1603.
Search Report dated Jun. 13, 2011, issued in the European Patent Application No. 11 16 1605.

* cited by examiner

VARISTOR COMPRISING AN ELECTRODE HAVING A PROTRUDING PORTION FORMING A POLE AND PROTECTION DEVICE COMPRISING SUCH A VARISTOR

RELATED APPLICATION

This application claims priority under 35 U.S.C. §119 to French Patent Application No. 1052735 filed in France on Apr. 9, 2010, the entire content of which is hereby incorporated by reference in its entirety.

FIELD

The present disclosure relates to the general technical field of devices for protecting equipment or electrical installations from overvoltages, such as from surges, due for example to a lightning strike. The present disclosure also relates to devices for protecting an electrical installation from surges, such as a varistor lightning arrestor, for low-voltage electrical installations.

BACKGROUND INFORMATION

It is known that the protection of an electrical installation from overvoltages can be achieved by using devices including at least one component for protection from overvoltages, for example one or more varistors and/or one or more spark gaps. For single phase installations, it is known to use a varistor connected between the phase and the neutral and a spark gap connected between the neutral and the ground. For three-phase installations, it is known to position varistors between the different phases and/or between each phase and the neutral and a spark gap between the neutral and the ground. For electrical installations operating under direct current, for example for photovoltaic generator installations, varistors and possibly spark gaps can be used.

In the event of failure of the protection component, these known devices include a disconnection system serving to isolate the protective component from the electrical installation as a safety measure. For example, in the case of varistors, it is known to provide thermal protection. The thermal protection or thermal disconnector can disconnect the varistor from the electrical installation to be protected in the event of excessive heating of the varistor, for example beyond 140° C. This excessive heating of the varistor is due to the increase of the leakage current—generally several tens of milliamperes—due to its aging, which is known as thermal runaway of the varistor.

The thermal disconnector often comprises (e.g., consists of) a low-temperature weld that keeps a conductive element in place to form a mobile contact through which the varistor is connected to the electrical installation, when the conductive element is elastically stressed towards the opening. The fusion of the weld results in the mobile contact moving under the effect of the elastic stress, which causes the disconnection of the varistor. Thermal disconnectors of this type are described in EP-A-0 716 493, EP-A-0 905 839, and EP-A-0 987 803, each of which is hereby incorporated by reference in its entirety.

These known devices which protect against overvoltages, and their thermal disconnector, can be faced with different restrictive situations during their use. The restrictive situations can depend, for example, on the type of electrical grid to which they are attached.

First, their thermal disconnector should have a sufficient interrupting capacity to effectively disconnect the protection component in case of thermal runaway. This constraint can be more delicate in the case of installations operating under direct current, given that there is no periodic passage at zero volts, as with alternating current. The alternating current contributes to the extension of the electric arc generated at the opening of the mobile contact.

The electrical circuit of the protective devices shall also be able to support the constraints resulting from electrical shocks, such as the lightning currents for which they are provided. These electric shocks can be surges with a significant amplitude (e.g., several thousand volts) and short duration (e.g., from a microsecond to a millisecond). These overvoltages, for example, can cause electrodynamic stresses and temperature increases that mechanically stress the different conductive pieces making up the protection device. Despite these mechanical stresses, the electrical circuit ensuring the connection of the protective component to the electrical installation should remain closed. In particular, the mechanical stresses should not cause the thermal disconnector to turn on via pulling out of the thermofusible braze. The ability of the device to meet this constraint can be verified by the applicable standards, for example, in installations supplied with low-voltage alternating current, in paragraph 7.6 (operating duty tests) of standard IEC 61643-1, 2nd ed., 2005-03 (hereafter noted IEC paragraph 7.6), or paragraph 37 (Surge testing) of standard UL 1449, 3rd ed., 09.29.2006 (hereafter noted UL paragraph 37). For direct current installations such as photovoltaic generator installations, examples include paragraph 6.6 (Operating duty tests) of photovoltaic guide UTE C 61-740-51 dated June 2009 (hereafter UTE paragraph 6.6).

Moreover, the electric circuit of the protective device connecting the protective component to the electrical installation can be subject to very high currents under the nominal voltage of the electrical installation, for example in installations powered by the alternating voltage grid. This example occurs when the varistor of the protection device experiences a power outage by short circuit. In this case, the disconnection of the failing varistor is caused by a specific protection from short circuits such as a fuse or a circuit-breaker. Given the reaction time of this specific protection, the electric circuit of the protection device, including the thermal disconnector, should not cause any fire outbreak in that period of time, given the significance of the short circuit currents provided by the electrical power grid. The ability of the device to satisfy this constraint can be verified for installations powered with low-voltage alternating current, for example in paragraph 7.7.3 (Short circuit withstand) of standard IEC 61643-1, 2nd ed., 2005-03 (hereafter noted IEC paragraph 7.7.3).

The device for protection from overvoltages can also be capable of being powered by a surge related to an anomaly in the voltage of the power grid of the electrical installation, when a power outage caused by a short circuit of a varistor if there are at least two varistors serially connected between the lines of the power grid. In such a case, the varistor turns on and can pass a very high current given its low independence. The current is more or less the short circuit current that the power grid of the electrical installation can supply. Faced with such a situation, the protective device should not cause a fire to start.

The ability of the protective device to satisfy this constraint can be verified for installations supplied with low-voltage alternating current, for example in paragraph 39 (Current testing) of standard UL 1449, 3rd 3d., 09.29.2006 (hereafter noted UL paragraph 39), or for photovoltaic generator installations, for example in paragraph 6.7.4 (End of life tests) from photovoltaic guide UTE C 61-740-51 dated June 2009 (hereafter noted UTE paragraph 6.7.4).

These protective devices should therefore, depending on the case, satisfy a number of constraints. The present disclosure sets forth exemplary embodiments which can contribute to a reliable disconnection in case of, for example, thermal disconnection for overvoltage protection devices that have a reduced bulk.

SUMMARY

A varistor is disclosed, comprising at least two connection poles, a block having a non-linear electrical resistance whose value will vary as a function of voltage applied to the two connection poles, and a conductive plate forming a contact electrode with the block. The conductive plate being arranged on a main face of the block and having a protruding portion forming one of the two connection poles. An electrically insulating coating applied to at least an assembly formed by said main face of the block and the conductive plate arranged on said main face of the block, wherein said protruding portion forming the one connection pole emerges from the electrically insulating coating and has a braze surface for electrical connection, said braze surface extending above the electrically insulating coating, and said protruding portion forming the one connection pole is connected to the conductive plate over at least half of a perimeter thereof.

BRIEF DESCRIPTION OF THE DRAWINGS

Other features and advantages of the disclosure will appear upon reading the following detailed description of exemplary embodiments of the disclosure, provided solely for information and with reference to the appended drawings, as follows.

DETAILED DESCRIPTION

Figure 1:
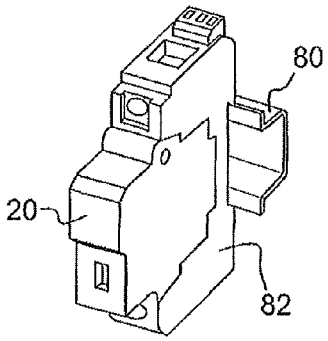
FIG. 1 illustrates a perspective view of a protective cartridge of a low-voltage electrical installation in accordance with an exemplary embodiment.

An exemplary varistor is disclosed, which comprises at least two connection poles, a block having a non-linear electrical resistance whose value varies as a function of the voltage applied to the two connection poles, and a conductive plate forming a contact electrode with the block. The conductive plate is arranged on a main face of the block and has a protruding portion forming one of the connection poles. The varistor also comprises an electrically insulating coating applied to at least the assembly formed by the main face of the block and the conductive plate arranged on the main face of the block. The protruding part forming the connection pole emerges from the electrically insulating coating and has a braze surface for its electrical connection, and the braze surface extending above the electrically insulating coating. The protruding part forming the connection pole is connected to the rest of the plate over at least half of the perimeter thereof.

According to an exemplary alternative, the part forming the connection pole can be connected to the rest of the plate over at least 80% of its perimeter and, for example, over its entire perimeter.

According to another exemplary alternative, the protruding part forming the connection pole can be formed by drawing of the plate.

According to another exemplary alternative, the braze surface can be situated at least 0.1 mm, and, for example, at least 0.3 mm, above the electrically insulating coating.

According to another exemplary alternative, the protruding part forming the connection pole can be situated inside an imaginary circle centered on the main face of the block and have a diameter equal to, for example, 75% of the diameter of the circle inscribed on the main face of the block.

According to another exemplary alternative, the conductive plate can be centered on the main face of the block.

According to another exemplary alternative, the rest of the conductive plate around the protruding part forming the connection pole can be solid.

According to another exemplary alternative, the surface of the plate in contact with the main face of the block can have an area that is at least half the area of the main face of the block.

According to another exemplary alternative, the braze surface can be parallel to the main face of the block.

According to another exemplary alternative, the varistor can be completely coated by the electrically insulating coating through which the other connection pole(s) also emerge.

The disclosure is also directed to a set of varistors assembled in a compact mass, comprising at least two varistors, at least one of which is the preceding varistor, in which the two varistors are electrically connected to each other and have a shared pole, the set of varistors being completely coated with the electrically insulating coating through which the connection poles of the varistors emerge.

The disclosure is also directed to a device for protecting an electrical installation from surges. The device comprises a varistor or a set of varistors, a thermal disconnector, comprising a mobile contact suitable to move from a closed position to an open position to disconnect the varistor or one of the varistors of the assembly, wherein the mobile contact is kept in the closed position by a thermofusible braze fastening the mobile contact on the braze surface of the protruding part forming the connection pole of the varistor. The thermal disconnector is provided to make the mobile contact move to the open position when the thermofusible braze melts, and the mobile contact is provided to move from the closed position to the open position, parallel to the main face of the block of the varistor and away from the electrically insulating coating of the varistor.

According to an exemplary alternative, the device comprises at least two terminals for connecting the device to the electrical installation and wherein the mobile contact can be a contact blade extending primarily in a plane parallel to the main face of the block of the varistor and mainly opposite the main face, the contact blade and one of the connection terminals being part of a single and same piece.

According to an exemplary alternative, the piece to which the contact blade and the one of the two connection terminals belong can have an IACS conductivity greater than or equal to, for example, 70%, preferably greater than or equal to, for example, 90%, still more preferably greater than or equal to, for example, 95%.

According to an exemplary alternative, the part of the contact blade maintained on the braze surface of said protruding part forming the pole is connected to the rest of the contact blade by a local restriction of the section of the blade to concentrate the heat given off by the varistor, one of the varistors of the assembly at the thermofusible braze.

The disclosure is also directed to an exemplary cartridge comprising:

a case, the device for protecting from the preceding, and pins for connecting the protective device to an electrical installation to be protected, wherein the protective device is housed in the case and the pins protrude outside the case, the case defining a parallelepiped inner volume in which the protective device is housed, the inner volume having maximum dimensions of 15×42×43 mm.

The disclosure also relates to an exemplary varistor, comprising at least two connection poles and a block having a non-linear electrical resistance whereof the value varies as a function of the voltage applied to the two connection poles. The block for example has a metal oxide base, the varistor then forms a metal oxide varistor (MOV). The varistor also comprises a conductive plate forming a contact electrode with the block, said conductive plate being arranged on a main face of the block. Said conductive plate has a protruding part forming one of the connection poles of the varistor.

An exemplary varistor can also include an electrically insulating coating applied at least to the assembly formed by the main face of the block on which the conductive plate is arranged. Moreover, the protruding part of the plate forming the connection pole emerges outside the electrically insulating coating. This part forming the pole then has a braze surface that extends above the electrically insulating coating for electrical connection of the pole. Furthermore, said protruding part forming the connection pole is connected to the rest of the plate over at least half of its perimeter.

An exemplary varistor can be used as a protective component of a device protecting an electrical installation from surges have the following exemplary features. It comprises, in addition to the varistor, a thermal disconnector, comprising a mobile contact suitable of going from a closed position to an open position to disconnect the varistor.

The mobile contact of the thermal disconnector can be kept in the closed position by a thermofusible braze fastening the mobile contact on the braze surface of the protruding part forming the connection pole of the varistor. The thermal disconnector can then be provided to make the mobile contact go to the open position when the thermofusible braze melts. The mobile contact can be provided to go from the closed position to the open position, parallel to the main face of the block of the varistor and away from the electrically insulating coating of the varistor.

The movement of the mobile contact parallel to the main face of the block of the varistor can ensure a reduced bulk of the protective device, as demonstrated later in the description.

The arrangement of the pole protruding and emerging from the electrically insulating coating can ensure that the mobile contact, initially in the closed position (e.g., welded to the braze surface of the pole), performs the movement parallel to the main face of the block of the varistor while remaining at a distance from the insulating coating. Thus, the movement towards the open position can be done without friction of the mobile contact on the electrically insulating coating, which makes it possible to improve the interruption capacity, as demonstrated in more detail in the continuation of this document. The arrangement of the pole protruding and emerging from the electrically insulating coating of the varistor therefore can allow the protective device to benefit from an improved interruption capacity in a reduced bulk.

The connection of the part forming the pole to the rest of the plate over, for example, at least 50% of the perimeter of the pole can ensure effective heat conduction from the plate towards the pole. Thus, the varistor previously described can cause an increase in the reaction time of the varistor, which is the time that elapses between the beginning of heating of the varistor and the temperature increase of the pole of the varistor. The improvement to this reaction time can limit the current passing through the varistor at the time of the thermal disconnection at a leakage current of the varistor not having too strong an intensity relative to the improved interruption capacity of the device.

The arrangement of the pole protruding and emerging from the electrically insulating coating of the varistor with a connection to the rest of the plate over at least half of the perimeter of the pole makes it possible to have the protective device have, in a reduced bulk, an interruption capacity sufficient to interrupt the electrical currents passing through the varistor at the time of the thermal disconnection. The varistor thus can ensure a reliable disconnection in case of thermal disconnection for overvoltage protection devices that have a reduced bulk.

FIG. 1 illustrates a perspective view of a protective cartridge 20 of a low-voltage electrical installation in accordance with an exemplary embodiment. The protective cartridge 20 comprises a protective device for protection from over voltages. This protective cartridge 20 can be pinned on a base 82, which can be mounted on a DIN rail with a standardized electric board. Pinning the cartridge 20 on a base 82 facilitates a connection of the protective device to the low-voltage electrical installation to be protected. As provided herein, "low-voltage electrical installation" refers to equipment with an assigned RMS voltage up to, for example, 1,000 V in alternating current or up to, for example, 1,500 V in direct current.

The fastening on a DIN rail is standard for such electrical installations. The described device for protecting from overvoltages is also adapted to the protection of photovoltaic generator installations.

The current use of cartridges and bases for a DIN rail, in the low-voltage field, can impose a compact design constraint of the devices for protecting from overvoltages.

Figure 2A:
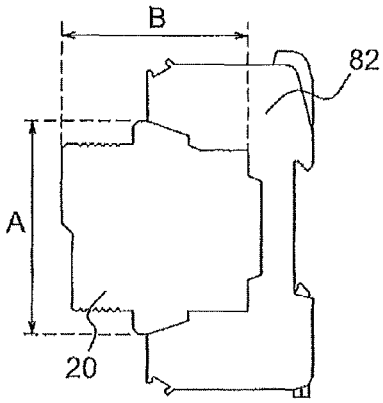
FIGS. 2A, 2B illustrate side and front views of a protective cartridge in accordance with an exemplary embodiment.
Figure 2B:
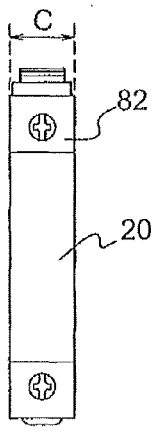

FIGS. 2A, 2B illustrate front and profile views of a protective cartridge in accordance with an exemplary embodiment.

FIGS. 2A and 2B, respectively, illustrate one of the main faces of the cartridge 20 and the edge of the cartridge 20. The cartridge 20, which houses the protective device has outer dimensions A×B×C smaller than or equal to 57×50.5×17.6 mm, for example.

Figure 3B:
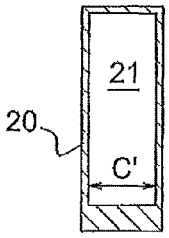
FIGS. 3A, 3B illustrate an inner volume defined by the case of the cartridge in accordance with an exemplary embodiment.
Figure 3A:
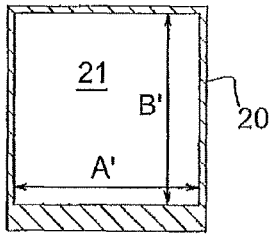

FIGS. 3A and 3B illustrate the inner volume 21 defined by the case of the cartridge 20 housing the protective device in accordance with an exemplary embodiment. FIG. 3A shows a cross-section of the case along one of the main faces of the case. FIG. 3B shows a cross-section of the case along the edge of the case. The cartridge 20 intended to house the protective device thus has a parallelepiped inner volume 21 having dimensions C'×A'×B' smaller than or equal to 15×42×43 mm, for example.

Described below are various exemplary features, which enable the protective device to have a compact structure, thereby allowing it to be housed in the inner volume 21.

Figure 4:
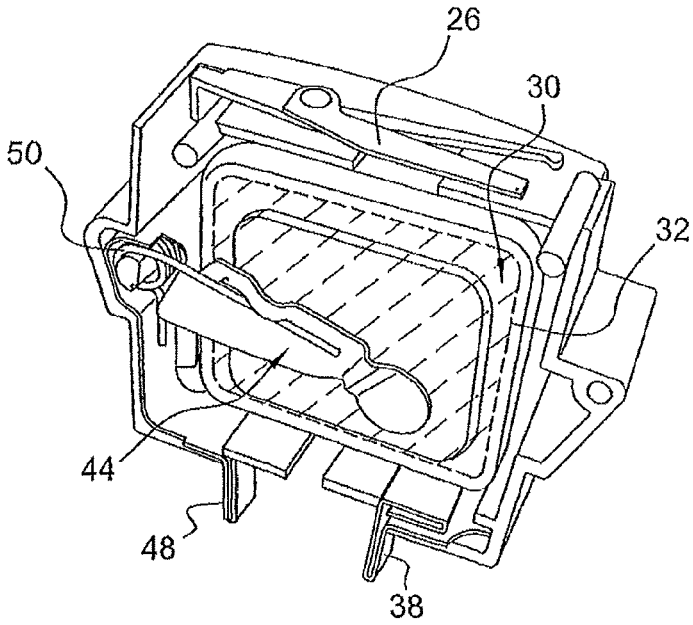
FIG. 4 illustrates a mobile contact of the protective device in the closed position in accordance with an exemplary embodiment.

FIG. 4 illustrates a mobile contact of the protective device in the closed position in accordance with an exemplary embodiment. As shown in FIG. 4, the cartridge 20 houses the protective device, which includes a varistor 30 as a protective component, and a conductive contact blade 44 that forms a mobile contact of a thermal disconnector. Alternatively, the mobile contact can be formed by a braid or a wire or other suitable structure as desired, to ensure the connection of the protective component to the electrical installation. The protective device 30 includes two terminals 38 and 48 for connecting the device to the electrical installation. The varistor 30 has two poles each connected to a respective one of the terminals 38 and 48. FIG. 4 shows the protective device with the contact blade 44 in the closed position. The contact blade 44 is electrically connected to the pole 34 (visible in FIG. 5) of the varistor 30. The pole 34 can thus constitute a fixed contact of the thermal disconnector. The pole 34 is connected to the terminal 48 via the contact blade 44. Moreover, the contact blade 44 is elastically stressed by a torsion spring 50. The connection of the terminals 38 and 48 to the electrical installation to be protected can be established, in this example, via the base 82 previously described with reference to FIG. 1. The terminals 38 and 48 can be implemented as male terminals, such as pins or other suitable structure as desired.

Figure 5:
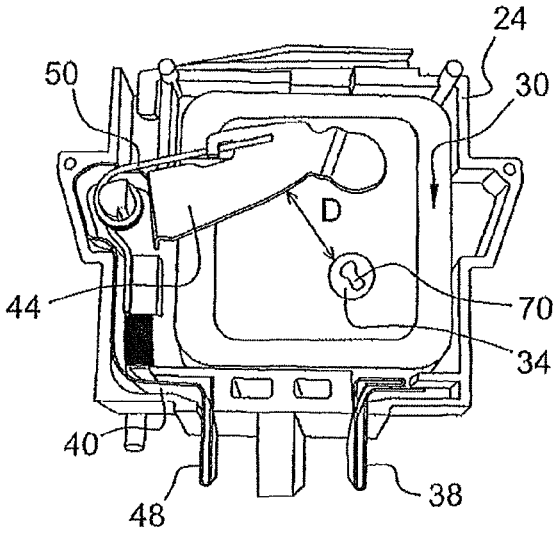
FIGS. 5 and 6 illustrates a mobile contact of the protective device in the open position and a diagram of the removed part of the case in accordance with an exemplary embodiment.
Figure 6:
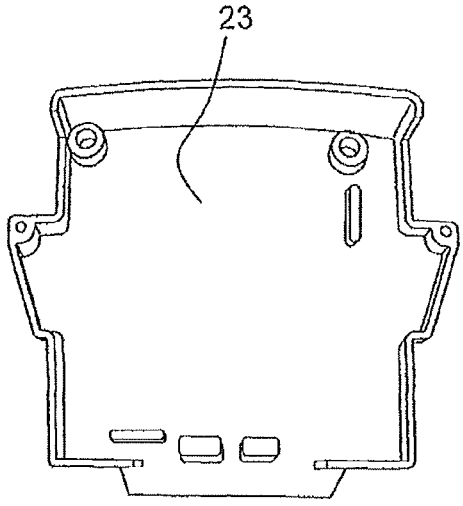

FIGS. 5 and 6 illustrates a mobile contact of the protective device in the open position and a diagram of the removed part of the case in accordance with an exemplary embodiment. FIG. 5 shows the same protective device with the contact blade 44 in the open position. The contact blade 44 can be disconnected from the pole 34 of the varistor 30. In this position, the pole 34 of the varistor 30 is no longer connected to the terminal 48.

FIGS. 5 and 6 illustrate the cartridge 20 with the case 20 of the cartridge open. The case is made up of an upper flange 23 shown in FIG. 6 and a lower flange 24 shown in FIG. 5. The compactness of the protective device enables the formation of an "equipped cradle" with the lower flange 24. FIG. 5 illustrates the contact blade 44 in the disconnected state.

The thermosensitive element of the thermal disconnector can be a thermofusible braze 70 via which the contact blade 44 is at the pole 34 of the varistor 30. This braze can be visible on the pole 34 of the varistor 30 as shown in FIG. 5. The braze 70 ensures the electrical connection between the blade 44 in the closed position and the terminal 34 until the protective component 30 reaches the threshold temperature (for example 140° C.), which is indicative of a failure of the varistor 30. When the varistor 30 reaches the threshold temperature, the braze 70 melts and the end of the contact blade 44 that was connected to the pole 34 of the varistor 30 moves away from the latter under the action of the spring 50. As a result, the electrical connection between the contact blade 44 and the pole 34 is broken.

In the exemplary embodiments of the present disclosure, the protective device can face surge situations without a risk of explosion or fire outbreak, at least if the protective device is likely to be subjected to such surge conditions. For example, the exemplary embodiments can be designed to satisfy the tests provided by the UL standard, paragraph 39 or by the UTE guide, paragraph 6.7.4. To this end, the disclosed exemplary embodiments provide fast thermal disconnection of the varistor 30. In these surge situations, current passing through the varistor increases gradually until the varistor goes into a steady-state short-circuit.

The time the varistor 30 spends in short circuit can depend, for example, on a ratio between the surge and the maximum operating voltage allowable by the varistor and the electric behavior of the varistor (e.g., variation of the resistivity of the varistor as a function of the voltage applied to it). On one hand, when the ratio between the surge and the maximum allowable voltage of the varistor 30 is high, the time spent by the varistor 30 in short circuit is low. On the other hand, when the behavior of the varistor is strongly non-linear (e.g., the resistivity of the varistor varies very sharply with the increase of the voltage applied to it), the time spent by the varistor 30 in short circuit is low. It is then possible to choose the varistor as a function of these different features to increase the time spent in steady-state short circuit under the in use conditions of the varistor. The current surge phase can be accompanied by an increase in the temperature of the varistor 30, during the time spent by the varistor in short circuit. The exemplary thermal disconnector can be designed to ensure a disconnection in the transitional phase of the behavior of the varistor before the current passing through it becomes too high to be able to be interrupted by the thermal disconnector. This design involves a fast detection of the increase in the temperature of the varistor.

Various technical characteristics of the exemplary embodiments of the present disclosure contribute to obtaining this fast disconnection.

The pole 34 can be arranged on one of the main faces of the protective component 30. Such a main face of the protective component is shown by the cross-hatched area 32 in FIGS. 4 and 5.

Figure 7:
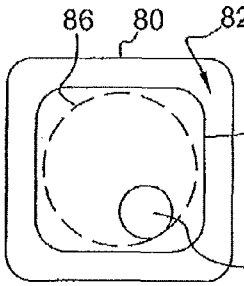
FIG. 7 illustrates a front view of the varistor housed with the rest of the protective device in the cartridge in accordance with an exemplary embodiment.

FIG. 7 illustrates a front view of the varistor housed with the rest of the protective device in the cartridge in accordance with an exemplary embodiment. FIG. 7 shows a perspective view of the varistor 30 seen perpendicularly to the plane of its main face 32. The pole 34 can be arranged inside a central area on the main face 32. This central area is represented by an imaging circle 86 in broken lines in FIG. 7. The central area can be situated inside the imaginary circle 86 centered on said main face 82 of the block 80 and having a diameter equal to 75%, for example, of the diameter of the circle drawn on the main face 82 of the block 80. The arrangement of the pole 34 on the main face 32 in the central area can ensure fast detection, by the thermofusible braze 70, of the increase in the temperature of the varistor 30 during the transitional phase where the current passing through it increases. The runaway of the varistor 30 can cause an increase in the temperature first in the deteriorated zones of the varistor 30. These deteriorated zones correspond to zones of the varistor 30 having uncontrolled design flaws. The location of these zones is not known a priori, such that the thermal runaway of the varistor starts in an undetermined area. The arrangement of the pole 34 in the central area can establish that the pole 34 is statistically closest to the area where the thermal runaway of the varistor begins.

The pole 34 of the varistor 30 can advantageously extend along the main face 32, and not protrude perpendicular thereto. As a result, the braze 70 is done on the pole 34 at a brazing surface that is parallel to the main face 32 of the varistor 30. The braze 70 has its thickness in a direction perpendicular to the main face of the protective component. As a result, the entire braze 70 is as close as possible to the varistor 30 and can establish immediate communication with it regarding the temperature of the varistor 30. This measure can be advantageous relative to known solutions in which the pole of the protective component forming the fixed contact of the thermal disconnector extends in a plane perpendicular to the main face of the protective component. The braze can extend along the perpendicular plane and part of the braze can be kept at a distance from the protective component. When the protective component fails, the braze is first stressed thermally in a portion closest to the protective component. The delay of a temperature increase of the varistor arriving at the portion of the braze that is farthest from the protective component 30, which can slow the thermal disconnection.

Moreover, the speed of thermal disconnection can also be improved by the exemplary varistor 30 of the present disclosure, through the electrode forming the pole of the varistor, which serves to transmit the heat given off by the varistor to the thermosensitive element of the thermal disconnector.

Thus, the electrode of the varistor can be formed by a conducting plate 84, as shown in FIG. 7. The varistor 30 can also include a block 80. The block 80 has an electrical resistance which varies as a function of the voltage applied to the block 80. This block 80 can establish the active part of the varistor 30 and can be used to limit the overvoltages by having a low resistance for overvoltages with high amplitudes like those occurring during lightning. The conducting plate 84 can be arranged on a main face 82 of the block 80. The main faces of the block 80 correspond to the main faces of the varistor 30. The plate 84 has a protruding part forming one of the connection poles 34 of the varistor. Similarly, a second pole 36 of the varistor 30 can be formed by a protruding part of a conducting plate arranged on another main face of the block 80 of the varistor 30.

The varistor 30 can include an electrically insulating coating applied on the assembly formed by the main face 82 of the block 80 and the plate 84. Thus, the assembly formed by the main face 82 of the block 80 and the plate 84 can be electrically insulated from its surrounding environment, including the mobile contact of the protective device. In an exemplary embodiment, the assembly formed by the block 80 and the plate 84 can be completely coated with the electrically insulating coating through which the different connection poles of the varistor also emerge to produce an electrical connection with the rest of the protective device, for example, with the contact blade 44.

The protruding part forming the pole 34 can emerge outside the electrically insulating coating to allow an improvement of the interrupting capacity as described below.

The protruding part forming the pole 34 can be connected to the rest of the plate 84 on at least half of its perimeter to improve the speed of the disconnection. During the deterioration of the varistor 30 subjected to surges, the leakage current of the varistor 30 increases until the varistor 30 goes into steady-state short circuit. This transitional phase for increase of the leakage current is accompanied by an increase in the temperature of the varistor 30. This temperature increase can be gradual. The temperature first increases in the core of the block 80 of the varistor 30 in areas having homogeneity flaws. The temperature increase can spread by conduction in the entire block 80 of the varistor up to the outer faces of the block for example, up to the main face 82 of the block 80. The arrangement of the conducting plate 84 on the main face 82 of the block 80 can allow a minimum propagation time of the temperature increase from the defective areas of the block 80 up to the plate 84 forming the electrode of the varistor 30. The plate 84 has an electrically conductive characteristic, allowing the plate to form an electrode. The plate 84 also has a thermally conductive characteristic to ensure a rapid propagation of the temperature increase to the pole 34 of the varistor 30 after the temperature increase has reached the plate 34. The conducting plate can be made of copper. The connection of the protruding part forming the pole 34 to the rest of the plate 84 over at least half of the perimeter of the pole 34 ensures effective thermal conduction from the plate 84 towards the pole 34, despite the location of the areas of the block 80 having defects relative to the pole 34. Over time, a decrease in the reaction time of the varistor can be observed. This is the time that elapses between the first deteriorations of areas of the block 80 of the varistor and the temperature increase of the pole 34 of the varistor 30.

Figure 8C:
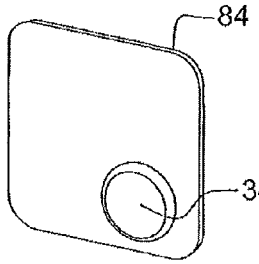
FIGS. 8A, 8B, and 8C each illustrate a perspective view of an electrode of the varistor in accordance with an exemplary embodiment.
Figure 8D:
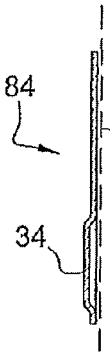
FIG. 8D illustrates a profile view of the electrode of the varistor.
Figure 8B:
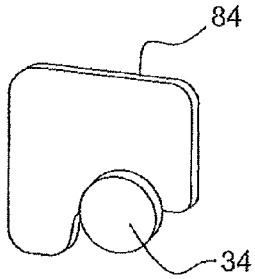
Figure 8A:
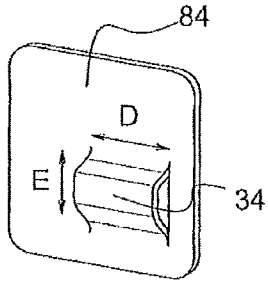

FIGS. 8A, 8B, and 8C each illustrate a perspective view of an electrode of the varistor in accordance with an exemplary embodiment. FIG. 8A illustrates one exemplary embodiment of the part forming the pole 34. This part forming the pole 34 can be connected to the rest of the plate 84 on its sides with dimensions D. The sides with dimensions E of the part forming the pole 34 have been cut out of the plate 84 and then do not participate in the thermal conduction.

FIG. 8B illustrates another exemplary embodiment of the part forming the pole 34. In this embodiment, the part forming the pole 34 can be arranged on the edge of the plate 84.

All of these embodiments forming the pole 34 have a connection with the rest of the plate over at least half of the perimeter of the pole 34.

For example, the part of the plate forming the connection pole can be connected to the rest of the plate 84 over at least 80%, for example, of its perimeter to ensure better thermal conduction.

In another example, the part forming the pole 34 can be connected to the rest of the plate 84 over its entire perimeter, as illustrated in FIG. 8C. The heat, due to the temperature increase of the block 80 and picked up by the plate 84, can then be thermally conducted to the pole 34 over its entire perimeter. The thermal transfer and the speed of the disconnection can thereby be improved.

All of these embodiments of the part forming the pole 34 were obtained by drawing of the plate 84. Drawing is a manufacturing technique to obtain, from a planar and thin sheet of metal, an object whereof the shape cannot be developed. In the embodiment of FIG. 8A, the plate 84 has been cut out beforehand to facilitate the deformation of the plate 84.

The formation of one of the poles of the varistor by drawing the plate 84 can establish continuity between the part of the plate arranged on the main face 82 of the block 80 and the drawn part.

The part of the plate 84 forming the pole 34 of the plate 84 can also be arranged at the central zone of the block 80 that corresponds to the central zone delimited by the imaginary circle 86 drawn in FIG. 7, which allows a fast speed of disconnection as previously demonstrated. With a similar result, in an exemplary embodiment the conducting plate 84 can be centered on said main face 82 of the block 80.

The rest of the conducting plate 84 around the protruding part forming the pole 34 can be solid. The rest of the plate 84 then does not have any material recess or hole inside the surface delimited by its outer perimeter. By not having holes, the plate 84 can have a significant surface for picking up the temperature increase of the block 80 to improve the speed of the thermal disconnection. With the same aim, the surface of the plate 84 can be arranged to be in contact with the main face 82 of the block 80 to have an area that is at least half the area of the main face 82 of the block 80.

In an exemplary embodiment, the plate 84 can have a thickness smaller than or equal to 0.7 mm so as to limit the amount of material to be heated before the temperature increase reaches the pole 34. The plate 84 can preferably have a thickness greater than or equal to 0.3 mm, for example, to allow the plate to withstand the mechanical stresses as described in the present disclosure.

Another measure comprises (e.g., consists of) choosing, for the thermofusible braze 70, an alloy with a low melting temperature to establish a quick disconnection of the contact blade 44. A low melting temperature of the braze 70 can be used to quickly obtain a covering of the thermal disconnector. In an exemplary embodiment, the tin/indium alloy In52Sn18 can be used because it has a liquidus temperature at 118° C. while the alloys traditionally used have a liquidus temperature generally greater than 130° C. Moreover, this alloy complies with European directive 2002/95/CE, called RoHS (Restriction of the use of certain Hazardous Substances in electrical and electronic equipment).

Figure 9:
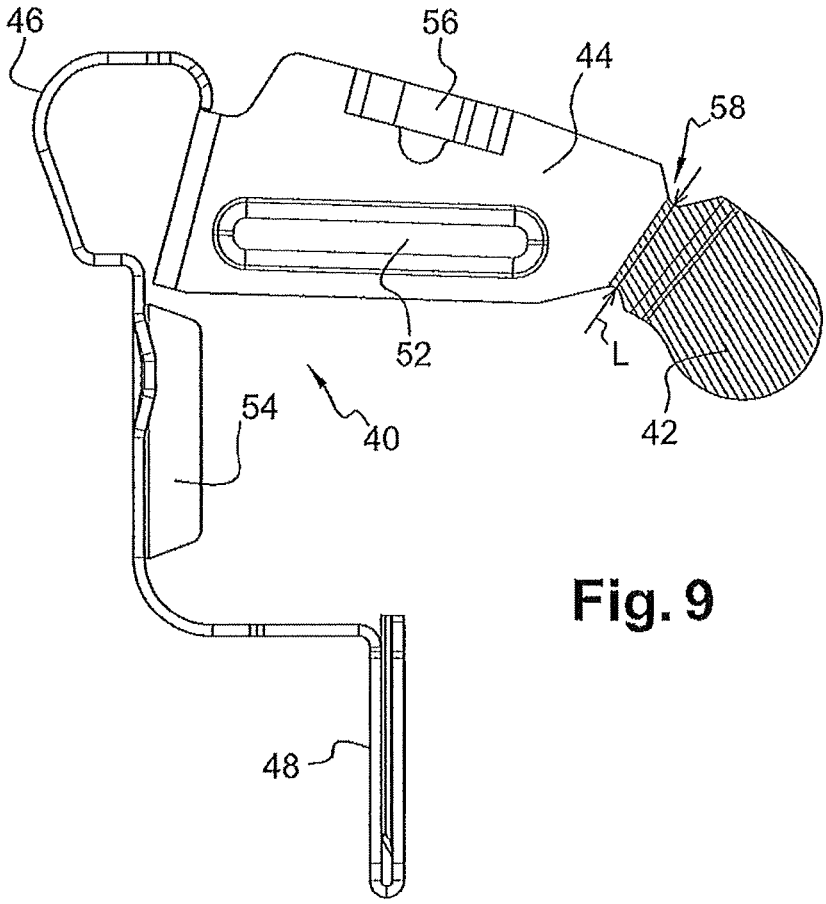
FIGS. 9 and 10 illustrate a profile and perspective view of an electrical contact piece in accordance with an exemplary embodiment.
Figure 10:
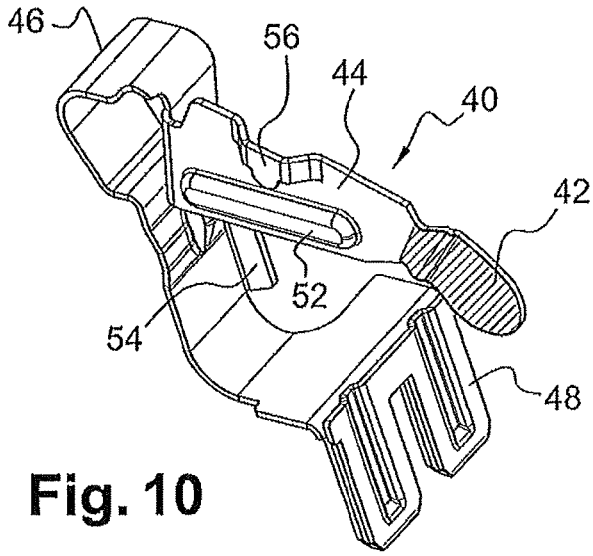

Still another measure comprises (e.g., consists of) optimizing the shape of the connecting blade 44. FIGS. 9 and 10 illustrate a profile and perspective view of an electrical contact piece in accordance with an exemplary embodiment. For example, FIGS. 9 and 10 illustrate, in profile and perspective, respectively, an exemplary embodiment of the connecting blade 44 of FIG. 5. The contact blade 44 has a part 42 that can be welded to the pole 34 by the braze 70. The part 42 can be connected to the rest of the contact blade 44 by a local restriction 58 of the section of the contact blade 44. This restriction 58 of the contact blade 44 can allow the concentration of heat released by the protective component 30 at the part 42—and therefore at the braze 70—because the diffusion of the heat from the part 42 towards the rest of the contact blade 44 is limited by the local restriction 58. As a result, the temperature increase of the braze 70 is faster during the temperature increase of the varistor 30. The speed of the opening of the thermal disconnector can then be increased.

The surface of the part 42 can correspond to the section of the braze 70. The section of the braze 70 can be chosen as a function of the mechanical considerations described below.

The part 42, as well as the braze 70, can have a disc shape to allow better homogeneity of the heating of the braze 70. The part 42 can thus have an average diameter of this disc. In an exemplary embodiment, the local restriction 58 can have a length smaller than 80% of the average diameter of the part 42 to establish a sensitive concentration effect on the braze 70 of the heat given off by the varistor 30. In another exemplary embodiment, the local restriction can have a length smaller than 70% of the average diameter of the part 42. The length of the aforementioned local restriction 58 can extend by the shortest distance separating two opposite edges of a main face of the contact blade 44: this length is referenced 'L' in FIG. 9.

The local restriction 58 can be arranged near the braze 70 to limit the losses of thermal energy between the local restriction 58 and the braze 70. The distance from the local restriction 58 to the braze 70 can be estimated by the ratio between the surface of the braze 70 (e.g. the section of the braze previously described) and the surface of the part 42 (shown by cross-hatching and to the right of the restriction 58 on FIG. 9). In an exemplary embodiment the ratio can be greater than 70%, and in another exemplary embodiment is preferably greater than, for example, 80%.

The exemplary characteristics previously described each can contribute to increasing the speed of the thermal disconnection, can be implemented independently of each other, in any suitable combination depending on the desired disconnection speed. These measures can be used to meet the specification of the UL standard paragraph 39 and/or of the UTE guide paragraph 6.7.4. Combining all of these measures can be used to meet the particularly strict specifications of the UL standard, paragraph 39.

In an exemplary embodiment, the protective device can be designed to have an improved interruption capacity. The improved interruption capacity can be useful both in the case of a thermal disconnection under nominal operating voltage and in the case of a surge such as in the tests of UL standard paragraph 39 and/or the UTE guide paragraph 6.7.4.

Different technical characteristics can contribute to obtaining an improved interrupting capacity.

Figure 11A:
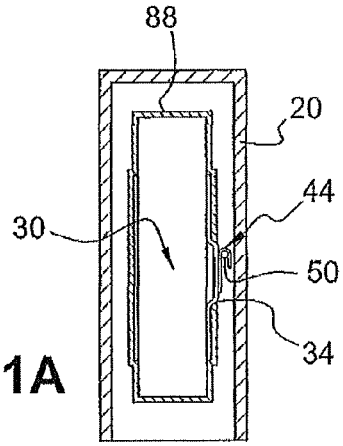
FIGS. 11A and 11B illustrate a cross-sectional view of a protective device and its equivalent electrical diagram in accordance with an exemplary embodiment.
Figure 11B:
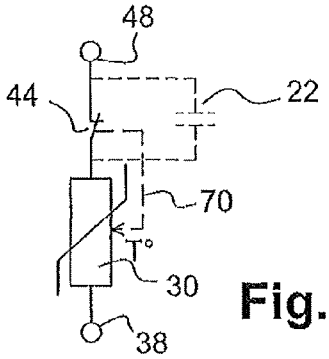

Thus, the protective device can comprise a member for reducing or eliminating arcs forming during the movement of the contact blade 44 towards the open position. Such an arc reduction or elimination member can be useful for electrical installations powered with direct current. Such members are for example made up of electrical means (such as a capacitor 22), electronic means, electromechanical means (such as an arc extinction chamber), or mechanical means (such as an insulating flap inserted between the mobile contact and the fixed contact, by elastic stress or by gravity). When the capacitor 22 is used, it can be positioned parallel to the thermal disconnector to reduce the voltage of the electric arc forming during the movement of the contact blade 44 towards its open position. In this sense, FIGS. 11A and 11B, illustrate a cross-sectional view of a protective device and its equivalent electrical diagram in accordance with an exemplary embodiment. FIG. 11B shows the electrical diagram corresponding to the protective device of FIG. 11A, which shows it diagrammatically in transverse cross-section.

Figure 12A:
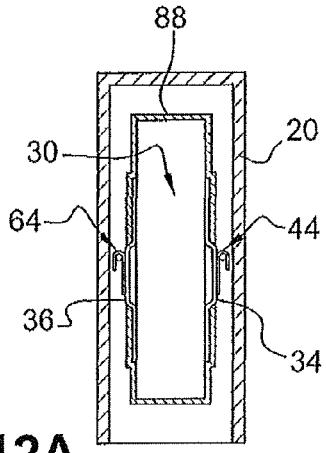
FIGS. 12A and 12B illustrate a cross-sectional view of an a protective device with split thermal disconnectors and its equivalent electrical diagram in accordance with an exemplary embodiment.
Figure 12B:
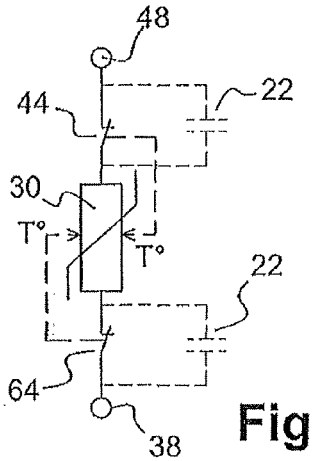

FIGS. 12A and 12B illustrate a cross-sectional view of a protective device with split thermal disconnectors and its equivalent electrical diagram in accordance with an exemplary embodiment. For the installations powered with direct current or those powered with alternating current, the protective device can include a second thermal disconnector as shown in FIGS. 12A and 12B. The second disconnector can be formed by a mobile contact 64 and a fixed contact 36 on the same varistor 30. The fixed contact 36 corresponds in FIG. 12A to the second pole of the varistor 30. The mobile contact 64 can be made by a contact blade similarly to the contact blade 44 of the first thermal disconnector. The presence of the second thermal disconnector on the same varistor can increase the interruption capacity of the proposed protective device, given that the clearances between mobile contact and fixed contact(s) of the two thermal disconnectors are added. As shown in FIG. 12B, which shows the equivalent electrical diagram of the protective device of FIG. 12A, it can be possible to have capacitors 22 in parallel with each of the thermal disconnectors to further improve the interruption capacity.

Moreover, as illustrated in FIG. 5, the protective device can include a torsion spring 50 to elastically stress the contact blade 44 from the closed position to the open position. In such an embodiment, when the varistor 30 reaches the threshold temperature, the braze 70 melts and releases the contact blade 44, which is driven towards the open position due to the elastic stress by the spring 50. The use of a spring 50 separate from the contact blade 44 can allow calibration of the opening speed of the contact blade 44 and precise orientation of the stress force of the contact blade 44. In traditional systems, the contact blades forming the mobile contact of a thermal disconnector can be elastically stressed due to the intrinsic elasticity of the contact blades. The elasticity can be intrinsically related to the contact blade, it is then difficult to provide a significant opening speed of the contact blade without modifying the geometry of the contact blade. In an exemplary embodiment of the present disclosure, the spring 50 can be dimensioned to drive the contact blade 44 towards the open position with a significant opening speed without altering the geometry of the contact blade 44. The contact blade 44 can then be defined solely as a function of other considerations. Moreover, the choice of a high opening speed of the thermal disconnector can be used to increase the interruption capacity of the disconnector.

As illustrated in FIGS. 9 and 10, the contact blade 44 comprises a support 56 for the spring 50, which can transmit the stress from the spring 50 to the contact blade 44. As shown in FIGS. 4 and 5, the contact blade 44 extends in a first plane parallel to the main face 32 of the varistor 30 with a movement of the contact blade 44 between the closed position and the open position being done mainly in this first plane. With reference to FIG. 5, it is thus possible to obtain a substantial clearance D between the mobile contact (e.g. the contact blade 44) and the fixed contact—(e.g. the pole 34) of the thermal disconnector. Thus, the clearance (e.g., insulation distance) for a thermal disconnector can be substantially greater than 5 mm, for example, and reach at least, for example, 10 mm.

Moreover, such a movement of the contact blade 44 in a plane parallel to the main face 32 can also allow obtaining a compact protective device that can be housed in the cartridge 20. In traditional solutions of thermal disconnectors formed by a disconnection contact blade, the movement of the contact blade towards the open position can be a movement in a direction perpendicularly to the main face of the protective component. In such devices, the increase of the disconnection distance goes through the increase of the thickness of the device (i.e. the dimension of the device in the direction perpendicular to a main face of the protective component), which damages its compactness.

The movement of the contact blade 44 parallel to the main face 32 of the varistor 30 can be confined in a volume having for base the main face 32 of the varistor and having a small thickness relative to the dimensions of the varistor. Such a movement of the blade 44 along the main face 32 of the varistor 30, and therefore having larger dimensions than the varistor 30, causes the possibility of obtaining a substantial interruption distance inside the volume confining the movement of the contact blade 44. The thickness of this volume being small, the compactness of the protective device can be close to the compactness of the varistor 30. This embodiment of the contact blade 44 can be particularly advantageous when the protective device comprises a second thermal disconnector on the same varistor as previously described. A compact design is then obtained according to FIG. 12A.

With reference to FIG. 8D and as previously described, the electrode 84 of the varistor 30 can have the protruding part forming the pole 34. This part forming the pole 34 emerges outside the electrically insulating coating such that the brazing surface for the electrical connection of the pole and drawn portion extends above the level of the electrically insulating coating, as shown by FIG. 12A.

The arrangement of the part of the plate 84 forming the pole 34 protruding and emerging from the electrically insulating coating ensures that the contact blade 44, forming the mobile contact, performs a movement towards the open position, in a manner parallel to the main face 32 of the varistor 30 while remaining at a distance from the insulating coating. The movement towards the open position is thus done without friction of the contact blade 44 on the insulating coating. The absence of friction of the contact blade 44 on the insulating coating can obtain a good disconnection speed without dragging liquefied residue from the braze 70 on the main face 32 of the varistor 30. In one example, a good disconnection speed of the thermal disconnector can contribute to improving the interruption capacity of the disconnector. In another example, preventing the formation of a trail of liquefied braze 70 can establish that the clearance procured by the thermal disconnector in the on state is indeed equal to the distance separating the contact blade 44 and the pole 34, thereby improving the interruption capacity.

The arrangement of the part of the plate 84 protruding to form the pole 34 can also electrically insulate the blade 44 from the electrically insulating coating without using an additional separating partition. The protective device can thus be made such that only an air blade separates the main face 32 from the contact blade 44 during its movement from the closed position towards the open position. The absence of an additional separating partition between the contact blade 44 and the main face 32 of the varistor 30 can further reduce the bulk of the protective device.

With the same aim of improving the interruption capacity, the part forming the pole 34 can have its braze surface at least 0.1 mm above the level of the electrically insulating coating. In an exemplary embodiment, the braze surface can be preferably situated at least, for example, 0.3 mm from the level of the electrically insulating coating.

In an exemplary embodiment, the electrically insulating coating can have a thickness between 0.1 mm and 1 mm. In another exemplary preferred embodiment, the thickness is greater than or equal to 0.6 mm to allow an improved electrical insulation of the varistor 30 relative to the rest of the protective device.

The previously described characteristics each contribute to increasing the interruption capacity. They can be implemented independently of each other, and in any combination depending on the desired interruption capacity.

The protective device can be designed to reliably withstand shock currents, for example, to pass the tests in standards IEC paragraph 7.6 or UL paragraph 37, or the UTE guide paragraph 6.6 depending on the case.

The production of the braze 70 in the plane of the main face 32 of the varistor 30 already described can withstand the electrodynamic stresses due to the lightning strike. The resistance of the braze 70 to the mechanical pulling out of electrodynamic forces can be adapted by increasing the section of the braze 70, for example, by increasing the surface of the braze 70 welded to the pole 34—(e.g., by increasing the brazing surface of the part forming the pole 34). In known solutions, the section of the brazing extends in a plane perpendicular to the main face of the protective component. The dimensioning of the section of the braze relative to the electrodynamic forces can cause an increase in the thickness of the entire protective device (i.e. in the direction perpendicular to the main face of the protective component). In the protective device proposed with the braze 70 made in the plane of the face 32 at the pole 34 arranged on the face 32, the increase in the section of the braze 70 is done along the plane of the face 32. The increase of the section of the braze 70 for resisting electrodynamic forces is not limited by the compactness requirement of the protective device. As a result, a section of the braze 70 that is larger than or equal to 50 mm2, for example, or even larger than or equal to 100 mm2, for example, can be obtained without affecting the compactness of the protective device to be housed in the cartridge 20 as previously described. Even for surfaces with a fairly substantial weld section, the speed of the disconnection can be satisfied with the different characteristics already described.

With reference to FIG. 9, the contact blade 44 can be secured to a flexible part 46. This flexible part 46 can form a bend 46 (or a lyre) around an axis perpendicular to the plane of FIG. 9. This bend 46 allows the contact blade 44 to move between the open position and the closed position. In case of shock currents passing through the protective device, the electrodynamic stresses stress the flexible bend 46 towards the open position. Such a stress towards the open position of the bend 46 can cause a stress of the contact blade 44 towards the open position. In other words, the electrodynamic forces can exert shearing stresses on the braze 70. However, as previously described, the braze 70 can be dimensioned to withstand stresses such as shearing without damaging the compactness of the device. The flexible bend 46 therefore can contribute both to the compactness of the protective device and its resistance to shock currents.

The shearing stress of the braze 70 can eliminate problems encountered during a traction stress of the braze. Indeed, in a situation involving traction of the braze, the strains in the braze may not be uniformly distributed. The part of the braze with the strongest strains can deteriorate locally, creating a start of the braze that decreases the effective section of the braze faced with the traction. There is then a cleavage situation where the most stressed part of the braze can gradually cause the entire braze to be pulled out. The shearing stress of the proposed braze allows a more uniform distribution of the strains in the braze 70, avoiding a situation equivalent to traction cleavage.

In an exemplary embodiment the material of the bend 46 can have a low elastic resistance (Re). A low elastic resistance allows the bend 46 to absorb part of the energy by opening in a plastic manner. The absorption of part of the energy due to the electrodynamic effects can limit the stress of the braze 70. The elastic resistance can be approached by the plastic deformation strain at 0.2% (noted Rp0.2). When the material used for the bend is copper Cu—Al as discussed in more detail below, the latter has an Rp0.2 that is low, e.g., 250 MPa (N·mm-2)).

The use of the tin/indium alloy In52Sn18 for the braze 70 can obtain a shearing resistance in the vicinity of 11.2 MPa (N·mm-2), which constitutes a good resistance compared to the alloys traditionally used for the braze. A known alloy such as Bi58Sn42 has a shearing resistance in the vicinity of only 3.4 MPa. As a result, the material contribution for the production of the braze 70 can be limited by decreasing the section of the braze 70 for example to an area of 25 mm2 while having a satisfactory mechanical shearing resistance.

As illustrated by FIGS. 9 and 10, the contact blade 44 can comprise a stiffening zone 52 of the piece 40. The bending inertia of the contact blade 44 can be increased so that the disconnection stress of the contact blade 44 by the spring 50 or by the electrodynamic forces is quasi-exclusively a pure shearing. The dimensioning of the braze 70 for resistance to shock currents can be facilitated. However, a low bending inertia can be provided between the part 42 of the contact blade 44 that is welded to the pole 34 and the restriction 58. This allows the dimensional play during assembly of the different pieces of the protective device without having to deform the contact blade 44 to weld it to the pole 34.

In an exemplary embodiment, the part 42 of the contact blade 44, intended to be welded to the pole 34 by the braze 70, can be tinned. The tinning of the part 42 can improve the quality of the braze causing better mechanical resistance thereof, for example, to the shock currents.

The exemplary characteristics previously described each contribute to increasing the mechanical resistance to shock currents while allowing a compact implementation of the protective device. They can be implemented independently of each other, and in any suitable combination depending on the desired mechanical resistance.

Due to the compactness, a varistor 30 with larger dimensions can be housed within cartridges having the dimensions mentioned relative to FIGS. 2A, 2B, 3A and 3B. For example, the varistor 30 can have a larger thickness, which allows a higher operating voltage of the varistor. In other words, the protective device can be adapted for an installation operating under a higher voltage, (e.g., between 500 and 1000 V in the case of photovoltaic generator installations), compared to the known 230 V or 400 V for alternating supply grids in Europe, for example.

Figure 13B:
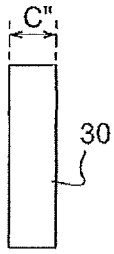
FIGS. 13A and 13B illustrate front and profile views of a protective component to be housed in an inner volume of a cartridge in accordance with an exemplary embodiment.
Figure 13A:
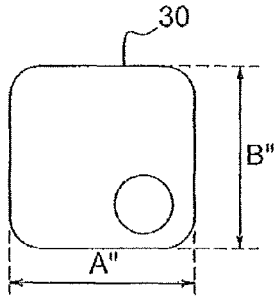

FIGS. 13A and 13B illustrate front and profile views of a protective component to be housed in an inner volume of a cartridge in accordance with an exemplary embodiment. FIGS. 13A and 13B illustrate, the dimensions A", B", C" of a varistor 30 capable of being housed in the cartridge 20 with the rest of the proposed compact protective device. The dimensions A" and B" of the varistor 30 can be equal to 35 mm. The varistor 30 can have a thickness C" of up to 9 mm. The varistor 30 with a thickness of 9 mm can have an exemplary operating voltage in the vicinity of 680 V and has a leakage current in the vicinity of, for example, 1 mA under a voltage of 1100 V in direct current. The compactness of the protective device allows use of a voltage range of for example, 75 V to 680 V, and allows the use of the protective device to protect photovoltaic generator installations.

According to an exemplary embodiment, as shown in FIG. 12A, the protective device having a dual thermal disconnector, the two poles 34 and 36 of the varistor 30 can be arranged on the main faces opposite the varistor 30. The first electrical disconnector, which comprises the contact blade 44 connected by thermofusible braze to the first pole 34 of the varistor 30, is made as previously described. The second thermal disconnector can comprise a contact blade 64 forming a mobile contact connected by thermofusible braze to the second pole 36 of the varistor 30. This second disconnector can have the same exemplary characteristics as the first disconnector, as described above.

In an exemplary embodiment, the protective device can be designed to resist, in complete safety, the varistor 30 experiencing a short circuit under nominal operating voltage for the time that specific short circuit protection—such as a fuse or circuit-breaker outside the device—intervenes. For example, it is provided to be able to satisfy standard IEC paragraph 7.7.3. The difficulty comes from the fact that this external protection has a certain reaction time during which high currents pass through the protective device. The protective device should not explode or trigger a fire during that time.

To achieve this objective, the conductive pieces of the protective device are limited, for example, in its thermal disconnector. Indeed, the short circuit current can cause heating of these pieces by the Joule effect. Uncontrolled heating of the different pieces of the protective device can lead to the melting of one of the pieces, constituting a possible fire outbreak before the external devices cut the current.

Different characteristics contribute to limiting the heating of the pieces of the protective device.

Thus, as illustrated by FIGS. 5, 9 and 10, the contact blade 44 and the terminal 48 are part of a single and same piece to form the piece 40. The piece 40 can be obtained by drawing, bending, or folding a laminated sheet. Because the piece 40 is not obtained by assembling several pieces, but only constitutes a single piece, the current passing through the piece 40 from the terminal 48 to the contact blade 44 does not encounter contact or weld electrical resistance. This absence of contact or weld electrical resistance limits the heating of the piece 40 when it is passed through by high intensity currents.

In an exemplary embodiment, the piece 40 can be made of copper with a sufficient purity to have an IACS (international annealed copper standard) conductivity greater than 70%. The IACS conductivity of a piece corresponds to the ratio between a resistivity of 1.7241 μΩ·cm and the resistivity of the piece, the IACS conductivity does not have dimensions. As a result, the piece 40 has a low electrical resistivity and therefore can establish the passage of the electrical current while limiting its heating. From this perspective, it can be advantageous for the purity of the copper to be such that its IACS conductivity is greater than or equal to 90%, or even 95%, for example. In another exemplary embodiment, copper such as Cu—Al (or Cu-ETP are electrolyte copper), having a purity of 99.9%, and an IACS conductivity of 100% can be used. The electrical resistivity of the piece 40 can be less than or equal to 1.7241 μΩ·cm, for example, and limit the heating of the piece 40 subject to short circuit currents. In known solutions, contact blades were used with an intrinsic elasticity to form the mobile contact of the thermal disconnector. However, while copper alloys procure a sufficient intrinsic elasticity, this elasticity is to the detriment of the resistivity, which is substantially higher. In an exemplary embodiment, the protective device, uses an elastic stress outside the contact blade 44 (by the spring 50 in our example) to produce a contact blade 44 with copper having a sufficient purity to substantially limit its heating during short circuit tests.

In an exemplary embodiment, the piece 40 can have a minimal section provided to allow the continuous passage, without deterioration, of a short circuit current to which the protective device can be exposed. Moreover, in another exemplary embodiment, the piece 40 can have a thickness of 0.4 mm to 0.6 mm, for example, to provide the flexibility of the bend 46 discussed above. The thickness of the sheet used to obtain the piece 40 can be equal to 0.5 mm.

Moreover, the contact blade 44 can have, outside the part 42, a substantial heat exchange area with the ambient air, but without compromising the compactness of the device. Thus, the main faces of the contact blade 44 can extend parallel to the main face 32 of the varistor 30. The contact blade 44 thereby acts as a cooling fin, which further improves the resistance of the piece 40 to short circuit currents.

The piece 40 can include zones with a maximum section to dissipate the heat obtained by the Joule effect with a substantially constant thickness, which can increase the contact surface of the piece 40 with the ambient air and limit the heating during the passage of the short circuit current. The maximum section of the piece 40 can be provided at the contact blade 44, between the bend 46 on one hand and the part 42 on the other, or if applicable the constriction 58.

An increase in the width of the piece 40 can also be provided between the bend 46 and the terminal 48. FIGS. 9 and 10 illustrate a cooling fin 54. This cooling fin 54, for example, can limit the temperature elevation of the flexible bend 46 during the passage of the short circuit current. The bend 46 can in fact have a minimal section of the piece 40 for shaping considerations of the piece 40, or for sufficient flexibility considerations of the bend 46.

The fact that the contact blade 44 can be provided with an exchange surface limiting the heating of the piece 40 can locally decrease the minimum section of the piece 40 previously mentioned, given the temporary nature of the short circuit. It is thus possible to produce the restriction 58 with a length smaller than or equal to 5.5 mm, or even 5 mm, for example, while staying, at that location, below the minimum section of the piece 40 as previously defined.

In an exemplary embodiment, the material of the piece 40 can be bare at the broaching 48 to limit the weld effect with the elastic couplings of the base 82 through which the protective device is electrically connected to the electrical installation to be protected.

The exemplary characteristics described above can each contribute to increasing the resistance to short circuit currents, for example, as verified by standard IEC paragraph 7.7.3. These characteristics can be implemented independently of each other, and in any suitable combination depending on the significance of the short circuit currents likely to be provided by the supply grid of the installation to be protected.

According to an exemplary embodiment, two protective components can be provided in the same cartridge 20.

Figure 14B:
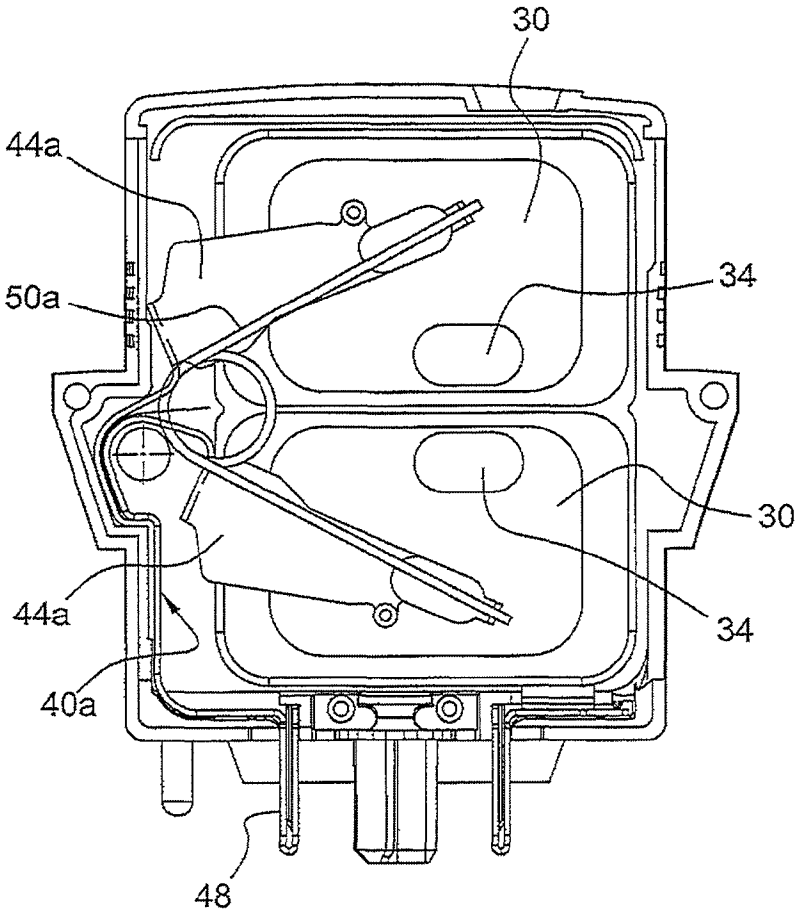
Figure 14A:
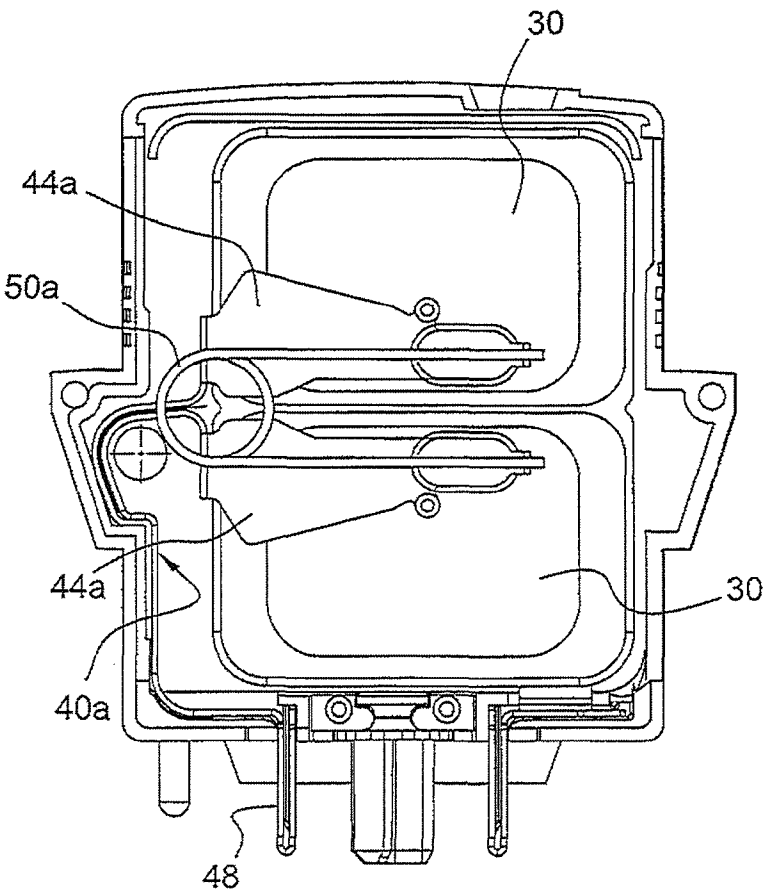
Figure 14C:
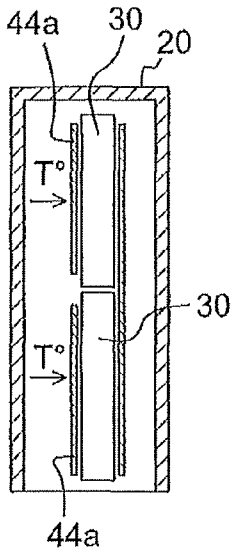

FIGS. 14A, 14B, 14C, 15A, 15B, and 16A illustrate different views of a protective device with two protective components in accordance with an exemplary embodiment. FIGS. 14A and 14B show the protective device comprising two varistors 30 each with a respective thermal disconnector comprising a contact blade 44*a* connected to the pole 34 of the corresponding varistor. FIG. 14A shows the protective device with the two thermal disconnectors in the closed position. FIG. 14B shows the protective device with the two thermal disconnectors in the open position. FIG. 14C shows, diagrammatically in transverse cross-section, one such embodiment of the protective device. The contact blades 44*a* can each be welded to one of the varistors 30 at one of their main faces. The other main faces of the varistors can be connected to each other so as to produce a serial assembly of the varistors 30.

Figure 15B:
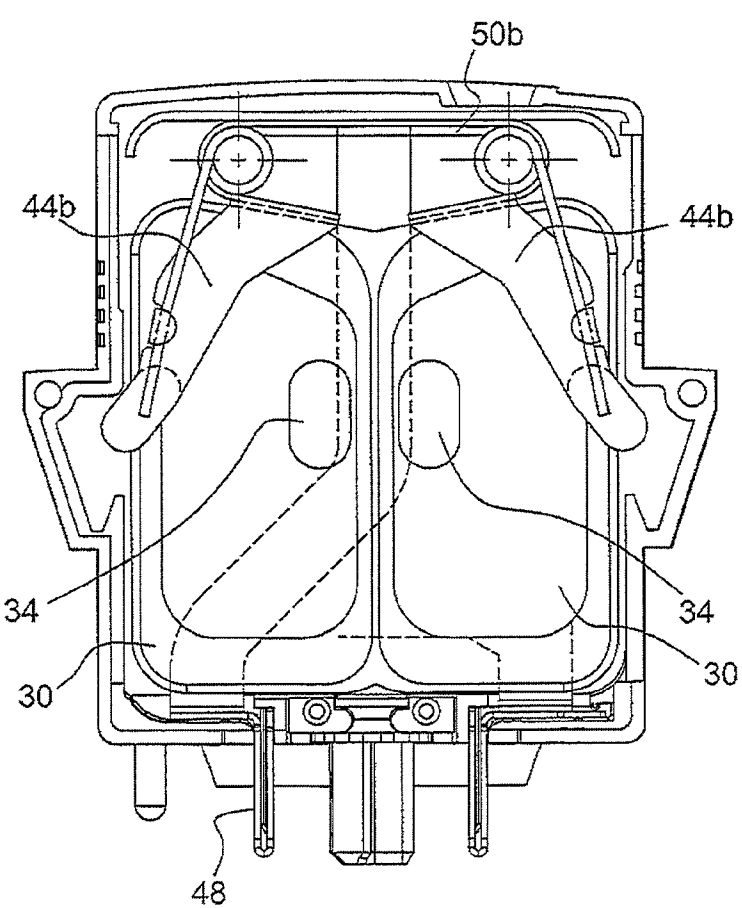
Figure 15A:
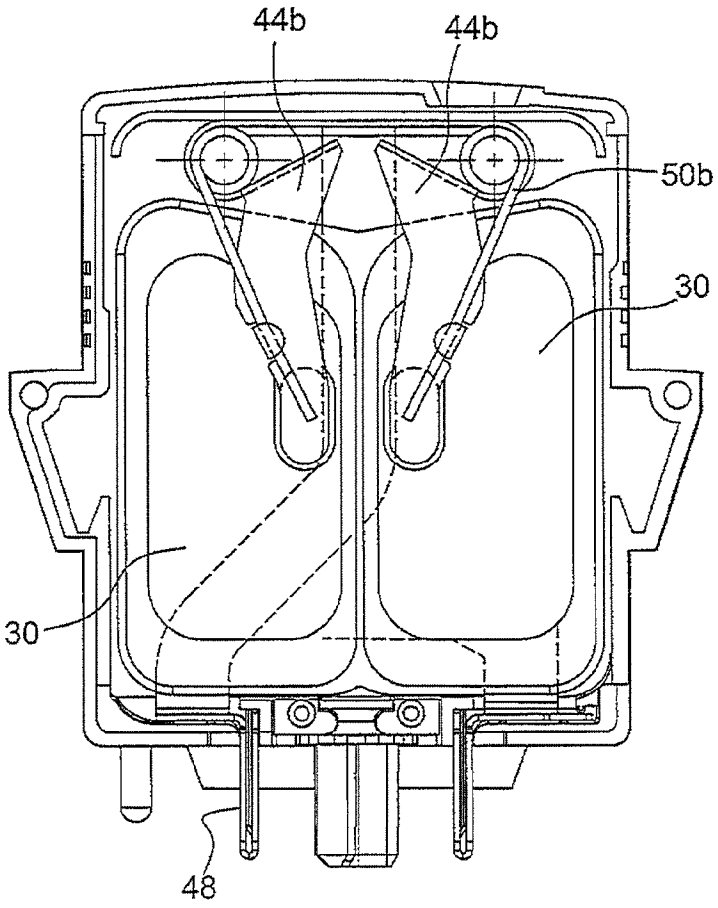

FIGS. 15A and 15B show an alternative embodiment of the protective device comprising two varistors 30 each with a respective thermal disconnector formed by a contact blade 44*b* connected to the pole 34 of the corresponding varistor. FIG. 15A shows the protective device with the two thermal disconnectors in the closed position. FIG. 15B shows the protective device with the two thermal disconnectors in the open position.

In the embodiments of FIGS. 14A, 14B, 14C, 15A and 15B, the varistors 30 can be arranged next to each other in a same plane parallel to the main faces of the varistors. With reference to FIG. 14C, the thickness of each varistor 30 can be similar to the thickness of the varistor 30 in the exemplary embodiments of the protective device with a single varistor. The operating voltage of the protective device can then stay the same.

The production of each thermal disconnector in these embodiments with two protective components can be in accordance with the preceding description. The contact blades 44*a* or 44*b* can be made in a manner similar to the preceding description. With reference to FIGS. 14A to 14C, in an exemplary embodiment, the contact blades 44*a* and the terminal 48 can be part of a single and same piece 40*a* so as to procure resistance to short circuit currents as previously described. With reference to FIGS. 15A and 15B, the contact blades 44*b* and the terminal 48 can be part of a single and same piece to procure resistance to the short circuit currents as previously described. In an exemplary embodiment of FIGS. 14A and 14B, the contact blades 44 can be elastically stressed by a single torsion spring 50*a*, whereas in the exemplary embodiment of FIGS. 15A and 15B, the contact blades 44 can be elastically stressed by a respective torsion spring made with a single wire 50*b*. The other numerical references of FIGS. 14A, 14B, 14C, 15A and 15B are the same as those used for the embodiments previously described.

Figure 16A:
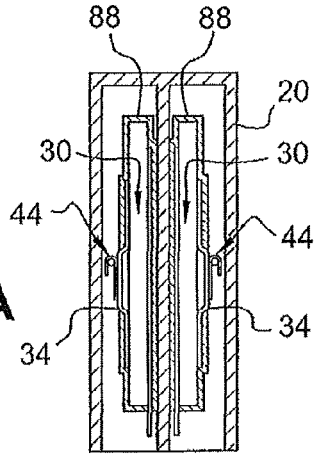
FIGS. 14A, 14B, 14C, 15A, 15B, and 16A illustrate different views of a protective device with two protective components in accordance with an exemplary embodiment.

FIG. 16A shows another alternative embodiment of the protective device comprising two varistors 30 each with a thermal disconnector formed by a respective contact blade 44 connected to a pole 34 of the respective varistor. In this exemplary embodiment, the varistors 30 can be arranged one above the other in the direction of the thickness of the cartridge 20. The compactness imparted by the previously described characteristics of the thermal disconnector produces an embodiment with unique operating voltages for the varistors 30.

Figure 16B:
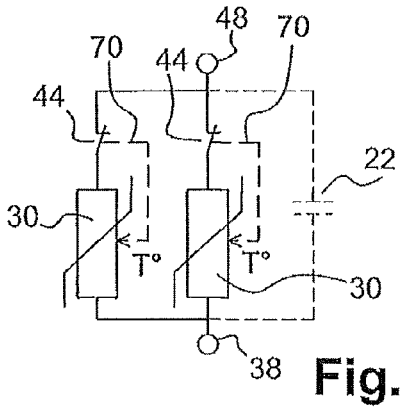
FIG. 16B illustrates an equivalent electrical diagram of a protective device with two protective components in accordance with an exemplary embodiment.

In these embodiments with two protective components 30 illustrated in FIGS. 14A, 14B, 15A, 15B and 16A, the protective device can have an electrical diagram in accordance with the one shown in FIG. 16B.

As illustrated in FIG. 16B, a capacitor 22 can be arranged in parallel with two thermal disconnectors to improve the interruption capacity, for example, during use in direct current.

The presence of this additional varistor in the same inner volume 21 of the cartridge 20 can establish the continuity of service and protection when one of the varistors, having reached the end of its life, has been disconnected. The disconnection of one of the varistors by a thermal disconnector can be indicated to the user of the electrical installation via a viewing element known in itself. The user is notified that one of the protective components of the cartridge 20 has reached the end of its life, with a function protecting against overvoltages still being ensured by the second varistor for the time it takes the user to replace the cartridge 20. FIG. 5 illustrates an exemplary embodiment of the element 26 for viewing the status of one of the thermal disconnectors.

Owing to the compactness of the thermal disconnector previously described, the protective devices of FIGS. 14A, 14B, 15A, 15B and 16A, 16B can be in a cartridge 20 with dimensions as defined above.

According to an exemplary embodiment, the thermal disconnector can be provided to include a plurality of varistors in the same protective component. These varistors can be connected serially and/or in parallel to each other depending on the applications. The varistors can then be assembled in a compact mass that comprises at least two varistors.

Figure 17A:
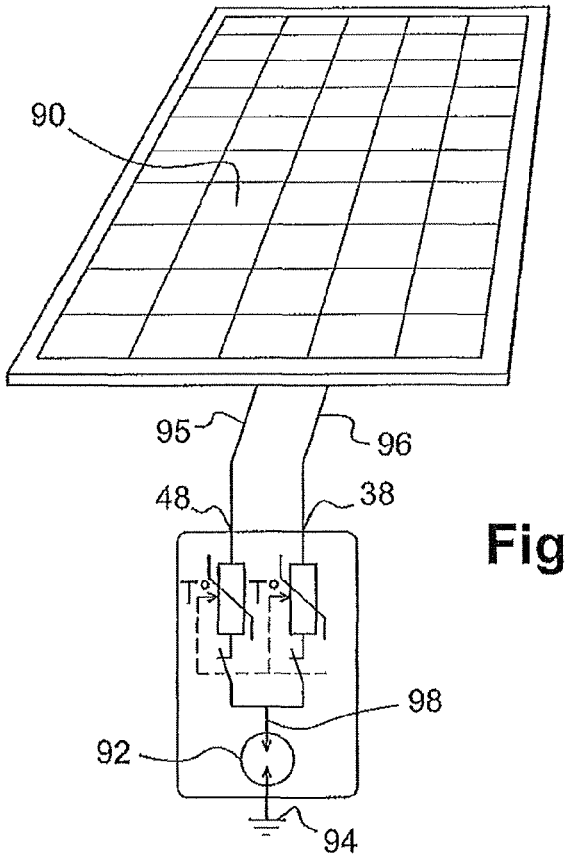
FIGS. 17A and 17B illustrate a protective device with a protective component having two non-linear blocks for a photovoltaic installation in accordance with an exemplary embodiment.
Figure 17B:
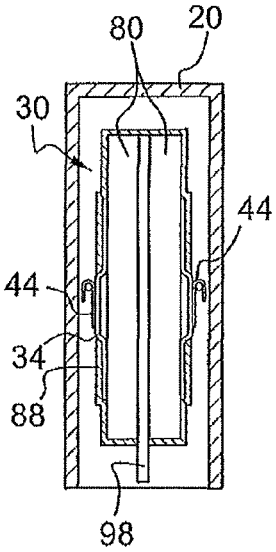

FIGS. 17A and 17B illustrate a protective device with a protective component having two non-linear blocks for a photovoltaic installation in accordance with an exemplary embodiment. FIG. 17B illustrates one such alternative embodiment of the protective component 30 made up of two blocks 80 having a non-linear electrical resistance. These two blocks 80 form two varistors. The protective component 30 can include an electrode 98 forming a shared pole of the varistors to electrically connect the two varistors to each other. The electrode 98 can connect a pole of the first block 30 to a pole of the second block 30. The other poles 34 of the blocks 80 can be connected to mobile contacts 44 of the thermal disconnectors electrically connected to the terminals 38 and 48 of the protective device as previously described. The set of varistors—e.g., the association of the two blocks 80—can be completely coated by the electrically insulating coating 88 through which the connection poles of the varistors, including the electrode 98, emerge. Such an embodiment of the protective component can achieve the serial association of two varistors with an intermediate potential connection via the electrode 98.

This exemplary embodiment of the protective component can be useful for protecting photovoltaic installations. FIG. 17A illustrates a photovoltaic installation comprising a photovoltaic panel 90. This panel 90 generates electrical voltage between the wires 95 and 96. A branch of the wires 95 and 96 (not shown) can recover the electrical current generated by the photovoltaic installation. To establish the protection of said installation from overvoltages, each of the wires 95 and 96 can be connected to one of the terminals 48 and 38 of the protective device comprising the above-described protective component 30. The electrode 98 of the protective component 30 is grounded 94 via a spark gap 92. Each of the wires 95 and 96 is thus grounded can be via a respective varistor and a shared spark gap 92.

Other exemplary embodiments of the protective component 30 can include associating a larger number of varistors serially or in parallel. One embodiment of the protective component 30 can include (e.g., consist of) superimposing several blocks 80 having a non-linear electrical resistance by connecting the blocks 80 via electrodes 98 in a manner similar to the embodiment illustrated in FIG. 17B. The set of these blocks 80 can be coated with the electrically insulating coating described above. According to one exemplary embodiment, the protective component 30 can be formed by superimposing three blocks 80 separated by electrodes 98. This protective component can have four poles, two of which are electrodes 98, to achieve protection from overvoltages in differential mode of a three-phase electrical installation.

According to another exemplary embodiment, the protective device can have more than two terminals for connecting to the electrical installation to be protected. Such an embodiment of the disclosure, for example, corresponds to the use of the protective component 30 with a number of poles greater than two such as the embodiment described with reference to FIGS. 17A and 17B.

The characteristics described above, considered all together or in any suitable combination as described, can produce devices for protecting against surges that can meet both the IEC and UL standards, as well as the UTE guide mentioned above. Each of these characteristics can, independently of the others or in combination, be implemented in the protective device according to the desired performance level. The protective device can produce benefits from the advantages associated with the characteristics previously described and that it incorporates.

These characteristics can be used to produce protective devices provided for a nominal operating voltage of up to 690V, for example, in alternating current under 50 Hz or 60 Hz and up to 895 V, for example, in direct current and having protection from lightning strikes with a nominal current (Imax) of 40 kA, for example, for a shock wave 8/20 according to the IEC standard and from lightning strikes with a nominal current (In) of 20 kA for a shock wave 8/20 according to the UL standard. These performances can be obtained with a single varistor chosen appropriately. The maximum nominal voltage can easily be increased by assembling one or several of these varistors serially.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A varistor, comprising:

at least two connection poles;

a block having a non-linear electrical resistance whose value will vary as a function of voltage applied to the two connection poles;

a conductive plate forming a contact electrode with the block, said conductive plate being arranged on a main face of the block and having a protruding portion forming one of the two connection poles; and an electrically insulating coating applied to at least an assembly formed by said main face of the block and the conductive plate arranged on said main face of the block, wherein:

said protruding portion forming the one connection pole emerges from the electrically insulating coating and has a braze surface for electrical connection, said braze surface extending above the electrically insulating coating; and said protruding portion forming the one connection pole is connected to the conductive plate over at least half of a perimeter thereof.

2. The varistor according to claim 1, wherein said protruding portion forming the one connection pole is connected to the plate over at least 80% of its perimeter.

3. The varistor according to claim 1, wherein said protruding portion forming the one connection pole is formed by drawing of the conductive plate.

4. The varistor according to claim 1, wherein said braze surface is situated at least 0.1 mm above the electrically insulating coating.

5. The varistor according to claim 1, wherein said protruding portion forming the one connection pole is situated inside an imaginary circle centered on said main face of the block and having a diameter equal to 75% of a diameter of the circle inscribed on the main face of the block.

6. The varistor according to claim 1, wherein the conductive plate is centered on said main face of the block.

7. The varistor according to claim 1, wherein a remainder of the conductive plate around the protruding portion forming the one connection pole is solid.

8. The varistor according to claim 1, wherein a surface of the conductive plate in contact with said main face of the block has an area that is at least half an area of the main face of the block.

9. The varistor according to claim 1, wherein the braze surface is parallel to said main face of the block.

10. The varistor according to claim 1, wherein the electrically insulating coating completely coats the varistor to form a coating through which an other of the two connection poles, or other connection poles, emerge.

11. The varistor according to claim 1, in combination with at least one other varistor to form a set of varistors assembled in a compact mass, wherein the two varistors are electrically connected to each other and have a shared pole, the set of varistors being completely coated with the electrically insulating coating through which connection poles of the varistors emerge.

12. The varistor according to claim 1, in combination with a protective device for protecting an electrical installation from voltage surges, comprising:

a thermal disconnector, comprising a mobile contact suitable of moving from a closed position to an open position to disconnect the varistor;

wherein the mobile contact is kept in the closed position by a thermofusible braze fastening the mobile contact on the braze surface of said protruding portion forming the one connection pole of the varistor, the thermal disconnector being provided for making the mobile contact go to the open position when the thermofusible braze melts, and wherein the mobile contact is provided for moving from the closed position to the open position, parallel to said main face of the block of the varistor and away from the electrically insulating coating of the varistor.

13. The varistor according to claim 12, wherein the protective device comprises:

at least two terminals for connecting the device to an electrical installation and wherein the mobile contact is a contact blade extending primarily in a plane parallel to said main face of the block of the varistor and mainly opposite said main face, the contact blade and one of the connection terminals being part of a single, common piece.

14. The varistor according to claim 13, wherein the piece to which the contact blade and said one of the two connection terminals belong has an IACS conductivity greater than or equal to 70%.

15. The varistor according to claim 13, wherein the part of the contact blade maintained on the braze surface of said protruding portion forming the one connection pole is connected to a remainder of the contact blade by a local restriction of a section of the contact blade to concentrate heat when given off by the varistor at the thermofusible braze.

16. The varistor according to claim 12, in combination with a cartridge comprising:

a case, the protective device for protecting an electrical installation from voltage surges; and pins for connecting the protective device to an electrical installation to be protected, wherein the protective device is housed in the case and the pins protrude outside the case, the case defining a parallelepiped inner volume in which the protective device is housed, an inner volume having maximum dimensions of 15×42×43 mm.

17. The varistor according to claim 1, wherein said protruding portion forming the one connection pole is connected to the plate over its entire perimeter.

18. The varistor according to claim 1, wherein said braze surface is situated at least 0.3 mm above the electrically insulating coating.

19. The varistor according to claim 13, wherein the piece to which the contact blade and said one of the two connection terminals belong has an IACS conductivity greater than or equal to 90%.

20. The varistor according to claim 13, wherein the piece to which the contact blade and said one of the two connection terminals belong has an IACS conductivity greater than or equal to 95%.

* * * * *